US006036832A

United States Patent [19]

Knol et al.

[11] Patent Number: 6,036,832

[45] Date of Patent: Mar. 14, 2000

[54] ELECTROFORMING METHOD, ELECTROFORMING MANDREL AND ELECTROFORMED PRODUCT

[75] Inventors: Harm Gerrit Knol, Geesteren; Cornelis J. Kruithof, Veldhoven; Cornelis J. M. van Rijn, Hengelo; Wietze Nijdam, Enschede, all of Netherlands

[73] Assignee: Stork Veco B.V., LB Eerbeek, Netherlands

[21] Appl. No.: 09/174,957

[22] Filed: Oct. 19, 1998

Related U.S. Application Data

[63] Continuation of application No. PCT/NL97/00203, Apr. 18, 1997.

[30] Foreign Application Priority Data

Apr. 19, 1996 [NL] Netherlands ..... 1002908

[51] Int. Cl.[7] ..... C25D 1/08; C25D 17/12

[52] U.S. Cl. ..... 205/50; 204/281; 205/75; 428/613; 428/935

[58] Field of Search ..... 205/50, 67, 75; 204/279, 280, 281; 428/596, 613, 935

[56] References Cited

U.S. PATENT DOCUMENTS

| | | | |
|---|---|---|---|
| 4,058,432 | 11/1977 | Schuster-Woldan et al. | 430/324 |
| 4,410,401 | 10/1983 | Anselrode | 205/75 |
| 4,490,217 | 12/1984 | Culp et al. | 205/75 |
| 4,700,482 | 10/1987 | Kraus | 33/1 PT |
| 4,772,540 | 9/1988 | Deutsch et al. | 430/320 |
| 4,844,778 | 7/1989 | Witte | 205/75 |

FOREIGN PATENT DOCUMENTS

| | | |
|---|---|---|
| 0192842A2 | 9/1986 | European Pat. Off. . |
| 0272764A1 | 6/1988 | European Pat. Off. . |
| 1001220C | 3/1996 | Netherlands . |

*Primary Examiner*—Kathryn Gorgos
*Assistant Examiner*—William T. Leader
*Attorney, Agent, or Firm*—Hoffman & Baron, LLP

[57] ABSTRACT

In an electroforming method for making metal products having a pattern of openings separated by dykes using a mandrel in an electroplating bath, metal from the bath is deposited on at least two electrically mutually insulated regions. Said regions comprise at least one main pattern for product dykes to be formed, which main pattern is electrically insulated from at least one ancillary pattern for a reinforcement to be formed. In the method according to the invention, first the ancillary pattern is connected to a current source in order to form reinforcement thereon and in order to effect an electrical connection between the ancillary pattern and the main pattern by means of the growing metal. During the continuation of the method, reinforcement is thickened and the product dykes are formed. A strong product having different thicknesses is therefore obtained in one step. A mandrel suitable for use in the method is also described.

11 Claims, 6 Drawing Sheets

ELECTROFORMING METHOD, ELECTROFORMING MANDREL AND ELECTROFORMED PRODUCT

This application is a continuation of copending application International Application No. PCT/NL97/00203, filed on Apr. 18, 1997, and which is designated the U.S.

BACKGROUND OF THE INVENTION

The invention relates to an electroforming method for producing metal products having a pattern of openings separated by dykes using an electroforming mandrel in an electroplating bath, wherein metal from the electroplating bath is deposited on electrically conducting regions of the mandrel, which regions comprise at least two regions electrically insulated from one another.

Such a method is disclosed in NL-$C^6$-1001220. A method is described therein for growing electroplating products in which a mandrel is used which is composed of a plastic substrate, a so-called stencil pattern layer made of plastic and an electrical contacting layer. The stencil pattern layer of the mandrel has (at least partly) a surface roughness of less than 100 nanometers in order to facilitate the detachment of grown products. The contacting layer comprises mutually electrically insulated parts which are each provided with a separate connecting wire. Furthermore, the contacting layer is preferably applied in the base of the stencil pattern layer. With the aid of such a mandrel, an electroplated growth product can be made with at least two different thicknesses or from at least two different materials by connecting the connecting wires selectively to a current source at a suitable time or by using different electroplating baths.

A disadvantage of the above method is that, to obtain an electroformed product having different thicknesses, the switching times for the selective connection of the mutually electrically insulated parts to a current source have to be monitored accurately.

Mandrels known in the art are, for example, used to make, in particular, flat precision products such as, for example, ink jets, coding discs and coding strips, screens for microfiltration and the like. A high dimensional accuracy can be achieved in the case of these products because, during the electroforming, metal, for example, nickel, can be deposited with the same thickness everywhere or virtually everywhere over a relatively large surface area. Products having an accurate thickness can therefore be made by exactly controlling the factors comprising amperes per unit surface area and processing time.

Another known mandrel used in electroforming comprises an electrically conducting substrate to which a pattern of resist islands, separated by electrically conducting dykes, is applied with the aid of photosensitive resist. Said resist islands correspond with the openings to be formed in the product. During electroforming using such a mandrel, the latter is placed in an electroplating bath and connected as cathode, as a result of which metal from the bath is deposited on the electrically conducting regions. During the deposition, not only upward growth in the height direction (i.e. perpendicular to the mandrel), but also lateral overgrowth over the resist islands takes place. If the electroforming is continued for too long, the product becomes too thick and the openings may be overgrown, which is undesirable.

In many precision products, such as the examples given above, a high density (number/unit surface area) of small openings in the product is desired or required, as a result of which the products can be made only with a limited thickness. In same cases, depending on the density and the dimensions of the openings, only a thickness of a few $\mu$m or even still less is possible. The disadvantage of such a small thickness is that, as a result, the products cannot be handled and, in addition, must not or cannot be mechanically loaded in an article or device assembled from such a product or during the assembly thereof.

In order to prevent the overgrowth of the openings and, nevertheless, to make the products with the required thickness, a multistage method is often used in practice in which a second much thicker growth is deposited on the first thin growth, the vulnerable regions, namely the openings being masked by photoresist. In fact, in this case, a second mandrel is placed on the first for the further growth. The final product acquires its strength, including rigidity, from the combined growth. However, this method is complex, expensive and complicated, inter alia because the second mandrel has to be positioned very accurately on the first one (alignment within a few $\mu$m is required).

SUMMARY OF THE INVENTION

The object of the present invention is to provide an electroforming method using a mandrel, which method is simpler than the multistage electroforming methods, and with which method it is possible to produce the required product strength in one process step without alignment having to be carried out and/or without switching times having to be monitored.

Furthermore, the object of the invention is to provide a mandrel suitable for use in the method according to the invention.

The method of the abovementioned type according to the invention is characterized in that the regions comprise at least one main pattern for product dykes to be formed, which main pattern is electrically insulated from at least one ancillary pattern for a reinforcement to be formed, in which process first the ancillary pattern is connected to a current source in order to form a reinforcement thereon and, after an electrical connection has been effected between the ancillary pattern and the main pattern by growing metal of the reinforcement, the reinforcement is thickened and product dykes are formed. By means of the method according to the invention, in which part of the reinforcement of the product is first allowed to grow on the ancillary pattern of the mandrel, which reinforcement effects an electrical contact between the ancillary pattern and the main pattern, and the reinforcement is then thickened and the product dykes are formed, a product having different thicknesses can be made continuously in one process step. In this case, no alignment of a second mandrel takes place. Furthermore, monitoring of the time for connecting the main pattern is unnecessary since, after starting the method, said connection is made automatically.

During the first phase, upward growth takes place on the ancillary pattern in the height direction and/or overgrowth in the lateral direction. After time has elapsed, the grown metal will make contact with the main pattern as a result of which the latter is also connected to the current source and starts to function as an electrically conducting region on which metal is likewise deposited during the continuation of the electroforming. After stopping the electroforming and removing the mandrel, the product comprises a relatively thick reinforcement framework and a pattern of openings separated by relatively thin dykes.

The thick reinforcement framework confers the desired strength on the product, so that it can easily be handled and can also be subjected to mechanical stress. The pattern of openings and dykes is of the required accuracy in terms of density and dimensions of the openings.

A preferred method is described in claim 2.

The mandrel according to the invention, as defined in claim 3, is characterized in that the regions comprise at least one main pattern for the product dykes to be formed, which main pattern is electrically insulated from at least one ancillary pattern for a reinforcement to be formed and in that the connecting means are connected only to the ancillary pattern.

The present mandrel is composed of an electrically insulating substrate in which or on which an electrically conducting coating is formed which has two or more different patterns which are not electrically connected to one another. Of said patterns, the ancillary pattern forms the first conducting pattern which, when the mandrel is used in electroforming, will be connected to a current source, as has already been explained above. The main pattern does not have its own connection to a current source. The main pattern, which is present in electrically insulated form, corresponds to the dykes to be formed in the product, which separate the openings. The ancillary pattern is at some distance from the main pattern. The effect of this structure of the mandrel according to the invention is that, during the electroforming, metal will first deposit on the electrically conducting regions of the ancillary pattern and, after time has elapsed, the grown metal will effect an electrical connection between the ancillary pattern and the main pattern by lateral overgrowth and/or upward growth after which the two patterns are allowed to grow further. The electrical connection between ancillary pattern and main pattern will be effected automatically so that the electroforming does not have to be interrupted in order to obtain the desired strength of the product. A product is thus obtained whose thickness of the reinforcement is greater than the thickness of the dykes which separate the openings in the product. Such a product can readily be handled as a consequence of the relatively thick reinforcement.

Of course, the mandrel disclosed in NL-$C^6$-1001220 can also be used in the method according to the invention, only one connecting wire of the electrical contacting layer being connected to a current source.

Preferred embodiments of the mandrel according to the invention are described in the dependent claims.

The mandrel may comprise a continuous substrate. Advantageously, in this case, at least part of the ancillary pattern is situated in recesses which are provided in the substrate surface. If such a mandrel is used, an electroformed product can be obtained whose formed reinforcement projects on either side out of the surface of the main pattern. As a result, the manipulability is increased further.

Another embodiment, which is preferred, of the mandrel according to the invention is a so-called through-flow mandrel, in which the substrate comprises through-flow openings which correspond to the openings of the metal product to be formed. If said mandrel is used, a forced flow of the bath liquid is maintained through the through-flow openings during at least part of the electroforming method. Examples of this electroforming procedure are described, for example, in EP-B1-0 038 104, EP-B1-0 049 022 and EP-B1-0 492 731.

The ancillary pattern can have any kind of shape provided it is not electrically connected to the main pattern. Examples of suitable shapes comprise tracks, rectangular, diamond-shaped and circular grids or parts of such grids, depending on the desired shape of the main pattern and the strength of the product. The width of the conductors forming the ancillary pattern will be chosen, inter alia, as a function of the required strength of the product to be made. Preferably, each main pattern is surrounded on all sides by an ancillary pattern situated at a distance therefrom. The distance between a main pattern and an ancillary pattern will be chosen as a function of the desired strength, in particular the thickness and width of the reinforcement of the final product, and also of the required pattern of openings in the product. The main pattern can have the shape usual for the end product, such as a pattern of square, rectangular or circular insulator regions surrounded by electrically conducting material.

The mandrel can be made with the aid of standard procedures, such as, for example, by photochemical means, in which an electrically conducting material layer is applied to the substrate and a photosensitive resist layer is then applied thereto, which photosensitive resist layer is exposed in accordance with the main pattern and ancillary pattern and developed, after which the electrically conducting material is etched away in the regions not screened by photosensitive resist. Other suitable procedures, such as vapour deposition of the electrically conducting patterns using a mask, can also be used.

The invention also relates to products formed in one electroforming step, having openings separated by dykes, whose thickness of the reinforcement is greater than the thickness of the webs. The fact that these products having different thicknesses are formed in one step gives these products a structure which differs from the known structures built up in a plurality of interrupted steps because no interface is present between the first and the second growth.

The electroforming mandrel and method according to the invention can be used to make all kinds of electroformed parts, for example screens, printing stencils for the printed circuit board industry, coding discs and coding strips, slit patterns in a rigid framework etc. Allowing two or more product thicknesses to grow in one method step can be used not only to obtain a rigid product with reinforcement, but can also be used, as, for example, in the case of ink jets, to make two or more product components, for example, a chamber having outflow openings, in one step.

BRIEF DESCRIPTION OF THE DRAWINGS

The invention will be further illustrated below by reference to the accompanying drawing, in which.

DETAILED DESCRIPTION OF THE INVENTION

Attention is drawn to the fact that the drawings are not shown to scale.

Figure 1:
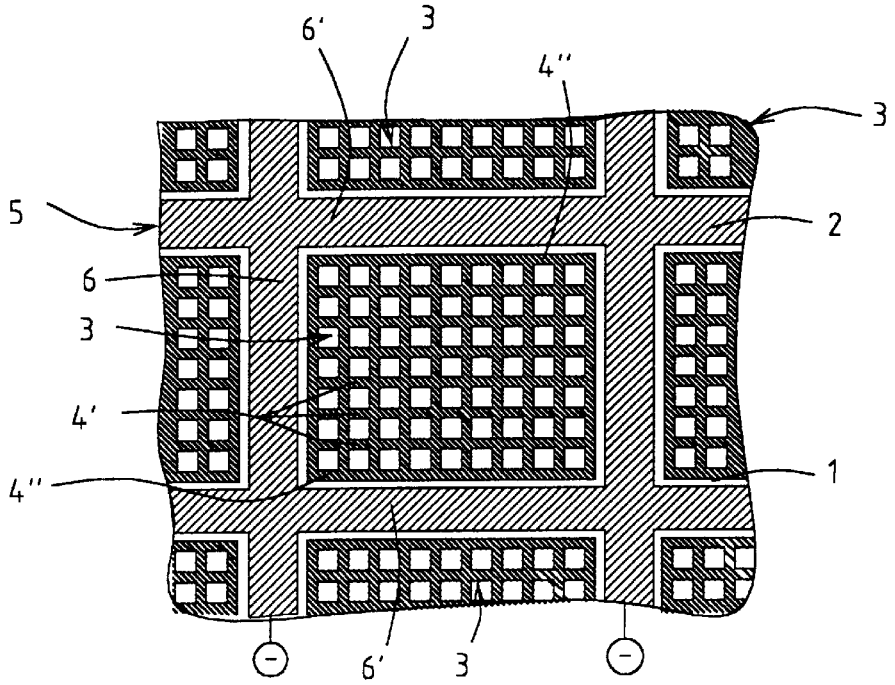
FIG. 1 shows a plan view of a part of an embodiment of an electroforming mandrel according to the invention.

FIG. 1 shows part of a plan view of an electroforming mandrel which is built up and made according to the invention. An electrically conducting coating 2 is first applied to the entire upper surface of an electrical insulator 1, from which coating a number of main patterns 3, comprising dykes 4, and an ancillary pattern 5 of tracks 6 are made in a photochemical manner. Said patterns are shown hatched. In order to form said patterns 3 and 5, respectively, a photosensitive resist layer is applied to the coating 2, which photosensitive resist layer is exposed in accordance with the patterns and developed, in which process the resist layer obtained therefrom masks the patterns. The unmasked regions are then locally etched away so that the insulator 1 (blank regions) is exposed there and the patterns 3 and 5, which are electrically insulated from one another, are thus formed after the mandrel is removed. In the example shown, the main pattern 3 comprises a regular grid of dykes 4, such as is desired, for example, for screen products.

The electroforming method according to the invention using the mandrel according to the invention shown in FIG. 1 will be explained by reference to FIG. 2, wherein the structure of an electroformed product with mandrel is diagrammatically shown at various points in time t0–t4. For the sake of clarity, the transverse tracks 6' and transverse dykes 4' (FIG. 1) are not shown. Time t0 indicates the starting situation. The ancillary pattern 5 of electrically conducting tracks 6 is then connected as cathode in an electroplating bath, as is also indicated in FIG. 1. Growth of reinforcements 7, for example made of nickel, then takes place in the height direction perpendicular to the tracks 6, as well as all round overgrowth over the exposed regions of the insulator 1 adjoining the tracks 6. At time t1, this upward and overt is clearly visible. At time t2, the lateral overgrowth has bridged the distance between the tracks 6 of the ancillary pattern 5 and the dykes 4 of the main patterns 3 so that the main patterns are also connected as cathode as a result of the electrical connection thus effected. During the continuation of the electroforming method, the product dykes 8 are formed and the reinforcements 7 thickened by means of the upward and overgrowth over both the dykes 4 and the tracks 6, respectively. The desired product thicknesses and the size of the product openings 9 can be controlled very accurately by suitable choice of the distance between the tracks 6 and the dykes 4 and the mutual distance between the dykes 4 and by controlling the factors comprising amperes per unit surface area and process time. At time t3, the desired thickness of the reinforcements 7 and the dykes 8 and the desired dimension of the openings 9 has been achieved and the electrical connection of the mandrel to the current source is interrupted and the electroforming is therefore stopped. The finished product 10 (time t4) is obtained after removal of the mandrel. As is evident from this, the product 10 comprises relatively thick reinforcements 7 which are situated along the circumference and within which a screen pattern of openings 9 separated by product dykes 8 is present. Said reinforcements 7 confer the desired strength on the otherwise thin product 10.

In the embodiment shown, recesses 11 are present in the reinforcements 7 and dykes 8 which correspond to the shape and dimensions of the ancillary pattern and main pattern 3, respectively. If a flat lower side of the product 10 is desired, this can be achieved in a simple manner by covering the exposed regions of the insulator 1 with an insulating material, for example photoresist, before starting the electroforming so that the lateral overgrowth of the tracks 6 of the ancillary pattern 5 will take place over said photoresist regions The same effect can be achieved by applying mn a suitable manner the patterns 3 and 5 in the upper surface of the insulator 1 so that the upper surfaces of the patterns are flush with the upper surface of the insulator.

Figure 2:
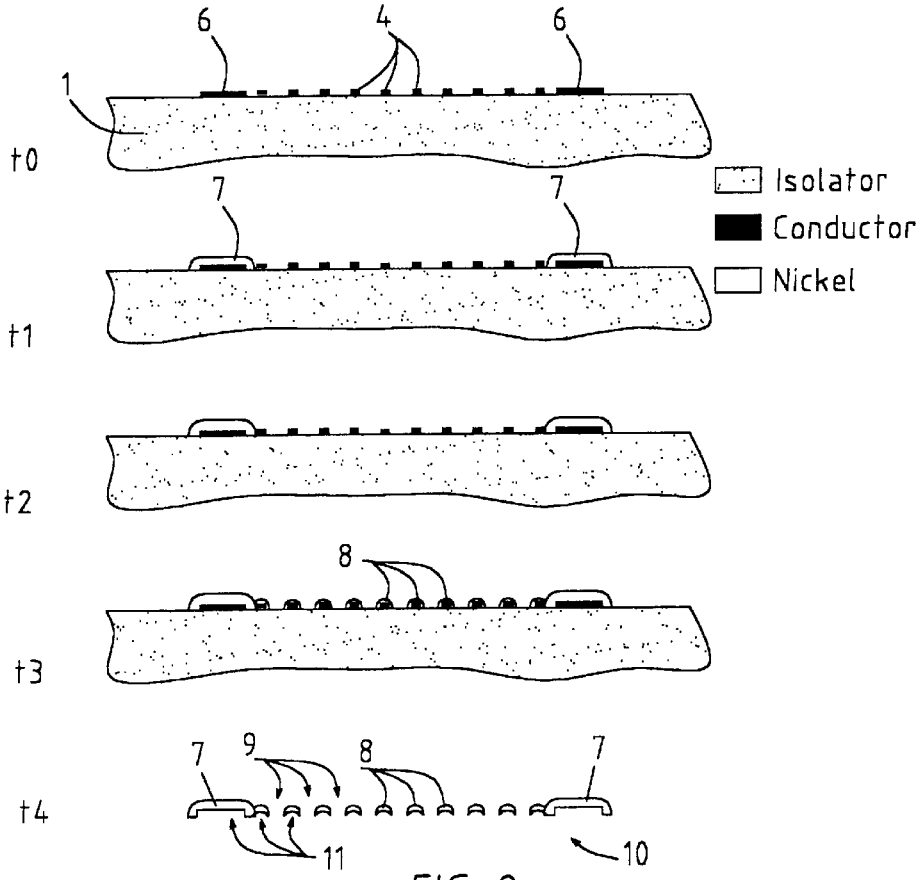
FIG. 2 diagrammatically shows the electroforming of a product using an electroforming mandrel according to FIG. 1 at various points in time.

The product shown in FIG. 2 has two different thicknesses at different positions. Obviously, this number of different thicknesses can be extended as required by applying, adjacently to a main pattern, one or more subpatterns insulated therefrom, so that during the electroforming, first the growth of the ancillary pattern takes place, then after electrical contact has been effected between the ancillary pattern and the maim pattern, the growth of these two patterns takes place and, finally, after the main pattern has also been electrically connected to the subpattern, the growth of all three patterns takes place. Examples of electroforming mandrels according to the invention for a product having such a structure are discussed below by reference to FIGS. 7–9.

It will be understood that there is no requirement for a main pattern to be surrounded by an ancillary pattern on all sides. If reinforcements are required only on two sides, the transverse tracks 6', for example, can be omitted. If the final product is to have slot-shaped openings, the central transverse dykes 4' in the main pattern 3 can be omitted, in which case only one or two outermost transverse dykes 4" are present in the main pattern.

In the figures discussed below, the same components are indicated by the same reference numerals.

Figure 3:
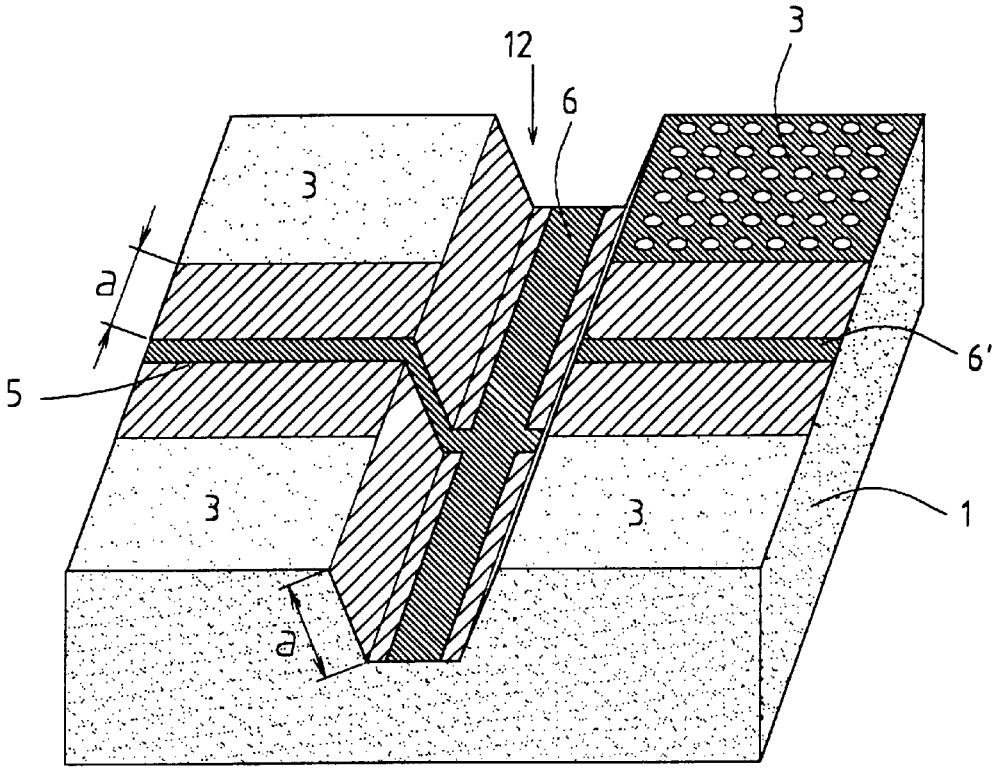
FIG. 3 shows a perspective view of a part of another embodiment of a mandrel according to the invention.

Another embodiment of a mandrel according to the invention is shown in FIG. 3. This mandrel comprises a substrate 1 made of insulating material. Provided in the upper surface of the substrate is a groove 12 on the base of which there is an electrical conductor 6 of an ancillary pattern 5. Said ancillary pattern 5 furthermore comprises a transverse conductor 6' which is situated on the substrate surface up to the point in the groove 12 where the conductors 6 and 6' cross one another. Furthermore, the mandrel comprises four main patterns 3, of which only one is shown in detail. Such a main pattern i rises a grid of dykes 4. The distance between the conductor 6 and a main pattern 3 is equal to the distance between the conductor 6' and a main pattern 3 (distance shown by a).

Figure 4:
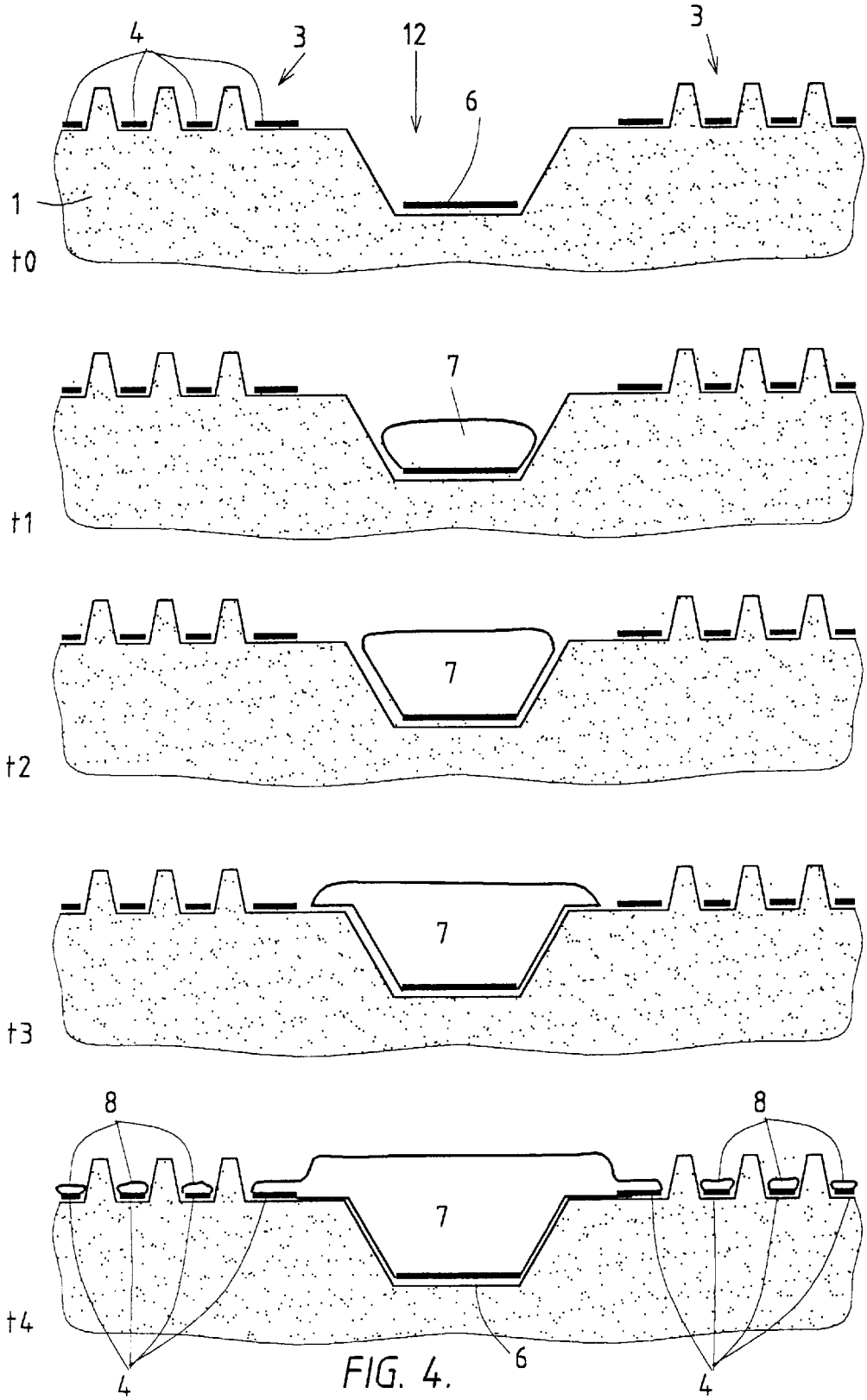
FIG. 4 diagrammatically shows the electroforming of a product using the mandrel according to FIG. 3.

The course of the electroforming method using this mandrel is shown diagrammatically in FIG. 4. At time tot the conductor 6 is connected as cathode, after which metal from an electroplating bath grows on said conductor 6 in accordance with the contours of the groove 12 and a reinforcement 7 therefore forms (time $t_1$) until the entire grove 12 is filled (time $t_2$), after which the metal will grow further both in the height direction and laterally ever the surface of the substrate (time $t_3$). After an electrical connection has been effected between the conductors 6 and 6' (not shown), on the one hand, and the dykes 4 of the main pattern 3, on the other hand, as a result of this further upward and overgrowth, metal growth will take place on the conducting parts of both patterns, as shown at time $t_4$. Because the distance between the ancillary pattern and the main pattern is equal everywhere, the electrical connection between the two patterns will take place at the same time and on all sides. A product made in this way has a strength which is still further improved and consequently improved manipulability, for example, better stackability and is easier to clean because the reinforcement framework projects at the front and back side of the region having openings. The dykes 4 do not have to touch the base of the upright parts. It may even be desirable for the dykes to be situated at some distance therefrom so that a product having greater through-put and a thicker reinforcement framework can be obtained. A further advantage is that the upright parts can be made lower in that case so that their vulnerability decreases.

Figure 5:
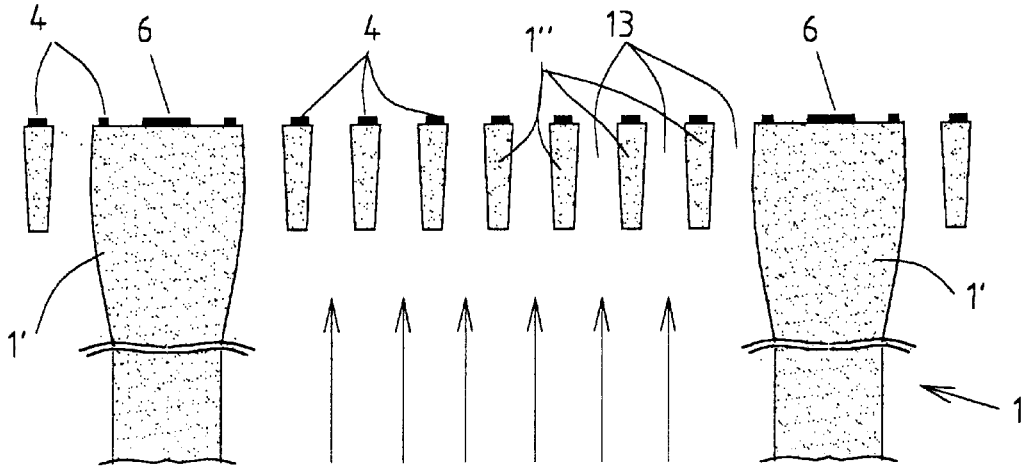
FIG. 5 is a section through an embodiment of a through-flow mandrel according to the invention.

FIG. 5 shows a cross-section of an embodiment of a through-flow mandrel according to the invention. In contrast to the mandrels discussed, the substrate 1 is not solid but provided with through-flow openings 13 through which a forced flow (shown by arrows) of bath liquid is maintained during the electroforming. A conductor 6 of a ancillary pattern 5 is situated on the wide substrate parts 1' and on both sides thereof a dyke 4 of the main pattern 3 is situated. Further dykes 4 of the main pattern 3 are situated on the thinner substrate parts 1".

Figure 6:
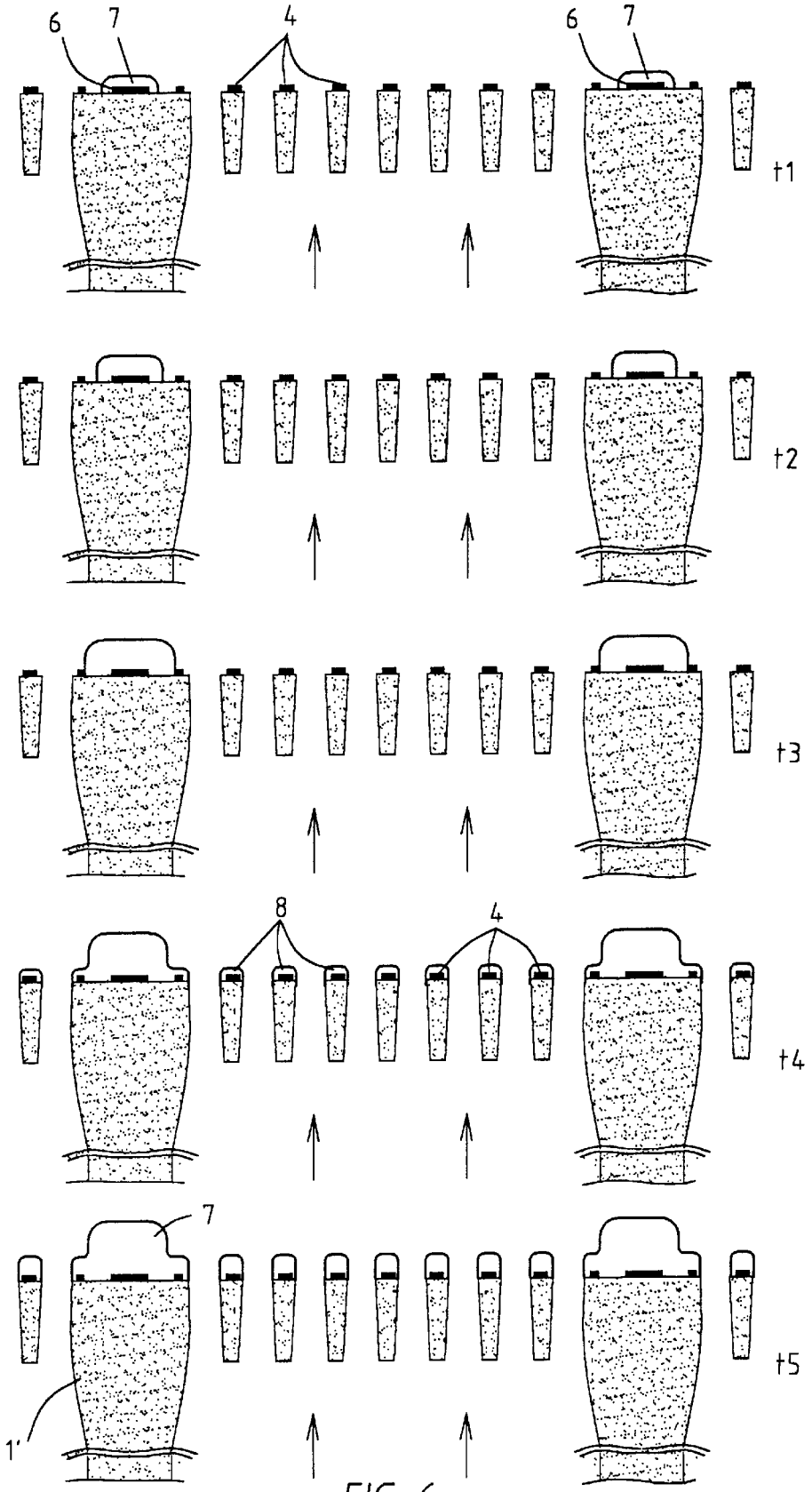
FIG. 6 diagrammatically shows the electroforming of a product using the mandrel according to FIG. 5.

The course of the electroforming method using this mandrel is shown in FIG. 6. Under the influence of the forced flow, metal deposition preferentially takes place in the height direction (parallel to the flow), in which process first the reinforcements 7 are formed by lateral overgrowth until an electrical connection is formed between ancillary pattern and main pattern. The method proceeds further analogously to the method described above according to FIGS. 2 and 4.

Figure 7:
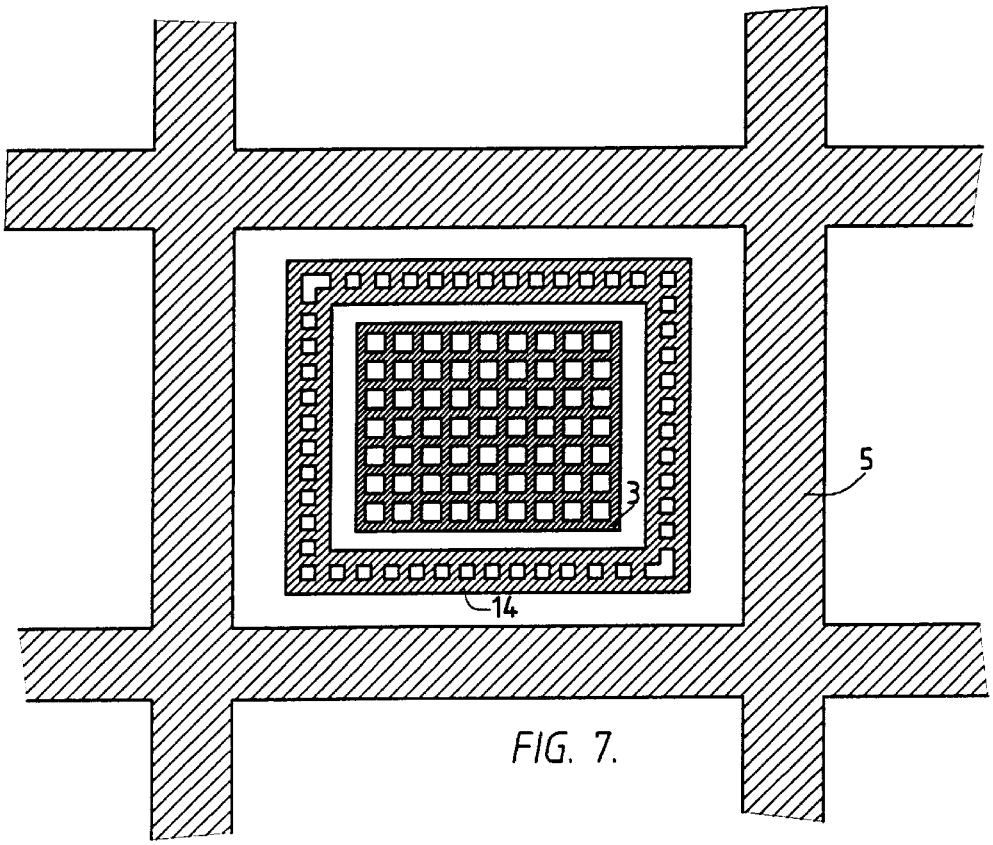
FIGS. 7–9 are three plan views of further exemplary embodiment of a mandrel according to the invention.
Figure 8:
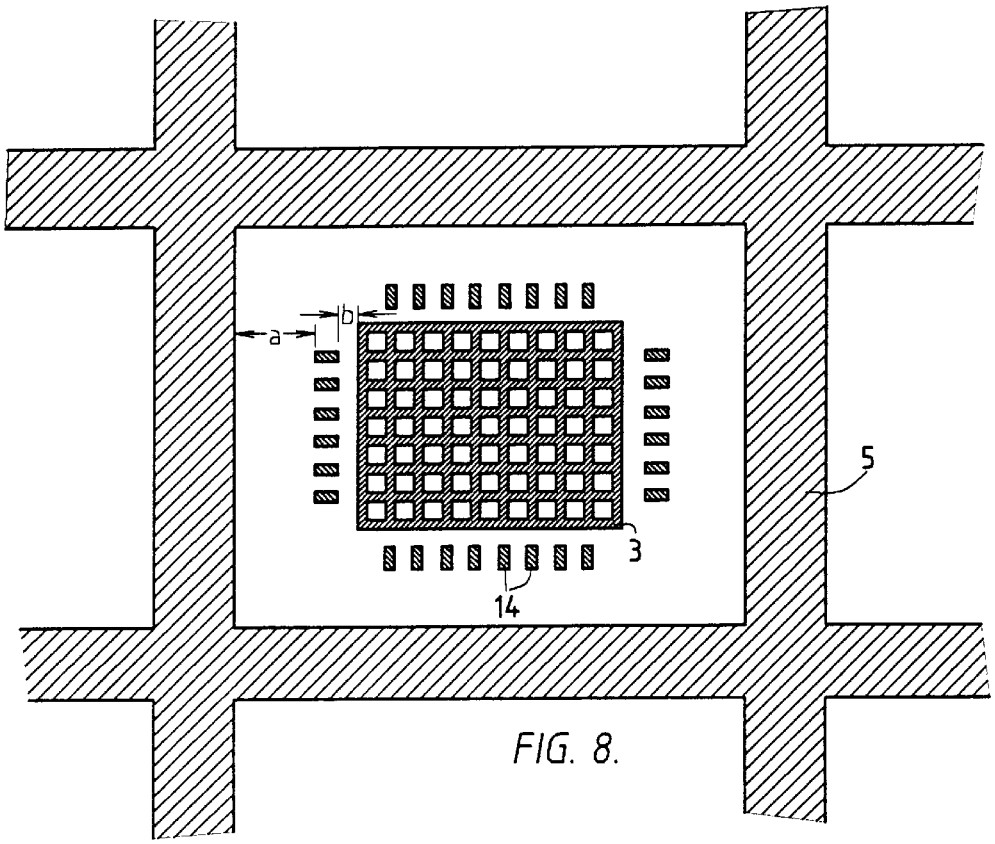
Figure 9:
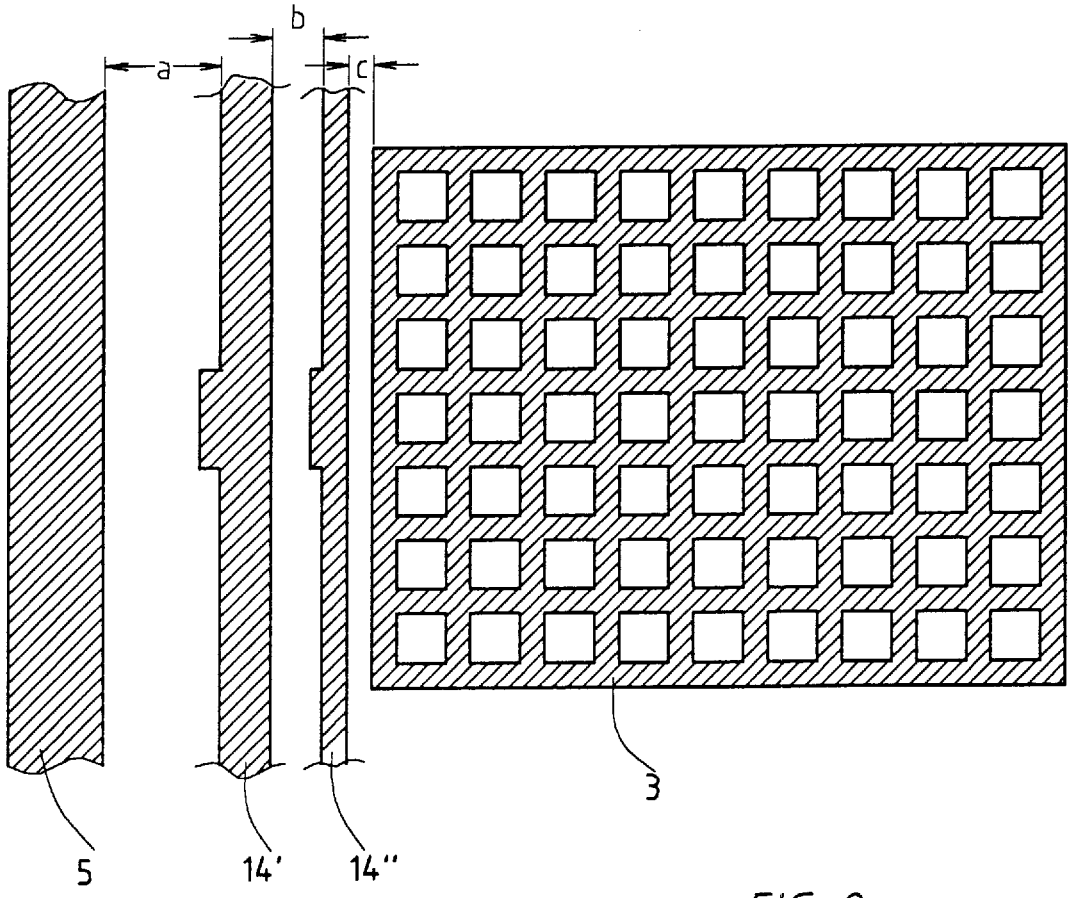

FIGS. 7–9 show three examples of mandrels according to the invention in which, in addition to a main pattern 3 and ancillary pattern 5, at least one subpattern or transition pattern 14 is present which is positioned in between.

During electroforming using the mandrel shown in FIG. 7, first the ancillary pattern 5 is connected to a current source so that metal growth takes place on said pattern 5. After an electrical connection has been effected between said ancillary pattern 5 and the transition pattern 14, metal deposition will take place on both patterns. After time has elapsed, the metal grown on the transition pattern 14 will make electrical contact with the main pattern 3 so that, finally, all three patterns will grow. A product can therefore be obtained with a gradual transition from thick reinforcement framework to thin region with openings, which is advantageous for limiting the risk of rupture of the product during removal from the mandrel.

The same advantages can also be achieved with the mandrels shown in FIGS. 8 and 9. As a result of a suitable choice of the distances between an ancillary pattern 5 and a transition pattern 14 (the distance is a) or between transition pattern 14 and main pattern 3 (the distance is b), respectively, local differences in the growth rate on the ancillary pattern 5 can be expediently compensated for so that the connection of the main pattern 3 takes place virtually on all sides and at the same tine. A requirement in this case is that the distance b is (much) smaller than the distance a (FIG. 8).

In the case of the mandrel according to FIG. 9, two transition patterns 14' and 14" are present between an ancillary pattern 5 and main pattern 3. The same advantages as above can be obtained given that a>>b>>c.

We claim:

1. An electroforming method for making metal products having a pattern of openings separated by dykes using an electroforming mandrel in an electroplating bath, wherein metal from the electroplating bath is deposited on the mandrel, comprising:

a.) providing the electroforming mandrel, including at least two electrically conducting regions electrically insulated from one another, said regions comprising at least one main pattern for product dykes to be formed, which main pattern is electrically insulated from at least one ancillary pattern for a reinforcement to be formed;

b.) connecting the ancillary pattern to a current source;

c.) electroforming to form a reinforcement on said ancillary pattern to effect an electrical connection between the ancillary pattern and the main pattern by grown metal; and, d.) continuing electroforming in order to thicken the reinforcement and to form product dykes.

2. An electroforming method according to claim 1 wherein the regions comprise one or more transition patterns situated between the main pattern and ancillary pattern, each transition pattern being electrically insulated from the other patterns.

3. A metal product produced by the process of claim 2 having a pattern of openings, and at least one reinforcement, which openings lie in one plane and are separated by dykes having thickness less than the thickness of the reinforcement, and wherein said reinforcement has no metal—metal interface.

4. A metal product according to claim 3, wherein the reinforcement projects at the front side and rear side above the remainder of the product.

5. An electroforming mandrel for making metal products having a pattern of openings separated by dykes by using the electroforming mandrel in an electroplating bath, wherein metal from the electroplating bath is deposited on the mandrel, comprising:

a.) a substrate made of an electrically insulating material;

b.) a layer of electrically conducting material, which layer comprises at least two regions electrically insulated from one another, the regions comprising at least one main pattern for the product dykes to be formed, which main pattern is electrically insulated from at least one ancillary pattern for a reinforcement to be formed; and, c.) connecting means for connecting the conducting material to a current source, wherein the connecting means are connected only to the ancillary pattern.

6. A mandrel according to claim 5, wherein the main pattern is surrounded on all sides by the ancillary pattern.

7. A mandrel according to claim 5, wherein the regions comprise one or more transition patterns situated between the main pattern and ancillary pattern, each transition pattern being electrically insulated form the other patterns.

8. A mandrel according to claim 5, wherein at least a part of the ancillary pattern is situated in recesses provided in the substrate surface.

9. A mandrel according to claim 5, wherein the ancillary pattern comprises conductors which are perpendicular to one another.

10. A mandrel according to claim 9, wherein said conductors are situated partly in two different planes.

11. A mandrel according to claim 5, wherein the mandrel is a through-flow mandrel having through-flow openings corresponding to the openings of a metal product to be formed.

* * * * *

UNITED STATES PATENT AND TRADEMARK OFFICE

CERTIFICATE OF CORRECTION

PATENT NO. : 6,036,832

DATED : MARCH 14, 2000

INVENTOR(S) : KNOL, et al.

It is certified that error appears in the above-identified patent and that said Letters Patent are hereby corrected as shown below:

At column 2, line 2, the printed patent incorrectly reads "In the same case,...", the patent should read --In some cases,...--.

At column 2, line 24, the printed patent incorrectly reads "simpler than the multistage...," the patent should read --simpler than the known multistage....--.

At column 5, line 37, the printed patent incorrectly reads "1 adjoining the tracts 6. At time t1, this upward and overt...", the patent should read --1 adjoining the tracts 6. At time tl, this upward and overgrowth...--.

At column 6, line 5, the printed patent incorrectly reads "region The same...", the patent should read --regions. The same...--.

At column 6, line 16, the printed patent incorrectly reads "the maim patent...", the patent should read --the main patent...--.

At column 6, line 43, the printed patent incorrectly reads "pattern i rises a grid...", the printed patent should read --pattern comprises a grid...--.

At column 6, line 48, the printed patent incorrectly reads "is shown diagrammitically in Fig. 4 at time tot the ...", the printed patent should read --is shown diagrammitically in Figure 4. At time t , the...--.

At column 6, line 54, the printed patent incorrectly reads "in the height direction and laterally ever the surface...", the printed patent should read --in the height direction and laterally over the surface...--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*